United States Patent [19]

Grunert et al.

[11] 4,309,683

[45] Jan. 5, 1982

[54] ELECTRIC CONTROL DEVICE

[75] Inventors: Kurt A. Grunert, Beaver; John J. Dauer, Jr., Brighton Township, Beaver County; Birch L. DeVault, Beaver, all of Pa.

[73] Assignee: Westinghouse Electric Corp., Pittsburgh, Pa.

[21] Appl. No.: 146,889

[22] Filed: May 5, 1980

[51] Int. Cl.[3] ..... H01H 67/02

[52] U.S. Cl. ..... 335/132; 335/121

[58] Field of Search ..... 335/121, 126, 127, 132, 335/196, 197, 202

[56] References Cited

U.S. PATENT DOCUMENTS

| | | | |
|---|---|---|---|
| 3,942,143 | 3/1976 | Pollmann et al. | 335/132 |
| 3,964,006 | 6/1976 | Lacan | 335/132 |
| 4,032,735 | 6/1977 | Butterworth | 335/132 X |
| 4,117,429 | 9/1978 | Streich et al. | 335/132 |

*Primary Examiner*—George Harris

*Attorney, Agent, or Firm*—Benjamin Hudson, Jr.

[57] ABSTRACT

This invention provides a novel and unique electric control device which utilizes a new auxiliary contact device. This new auxiliary contact device has a contact-carrying structure that is directly engaged with the operating mechanism of the electric control device whereby the operating mechanism directly moves the auxiliary contact device to all operating positions eliminating any requirement for biasing the auxiliary contacts into any normal position.

2 Claims, 5 Drawing Figures

ELECTRIC CONTROL DEVICE

BACKGROUND OF THE INVENTION

1. Field of the Invention

This invention relates generally to electric control devices and more particularly to contactors and relays that are operated by electromagnetic operating means and use auxiliary contacts for interlocking functions in electric control schemes.

2. Description of the Prior Art

In the art of electric control, designers have continuously sought control devices that are both reliable and efficient. Electric control devices have been provided that utilize auxiliary contact combinations for separate interlocking functions in numerous variations. Traditionally, these auxiliary contact devices have been actuated by an actuating member connected to the electromagnetic operating means responsible for opening and closing the electric circuit. The actuating member is disposed to move a contact-carrying structure of the auxiliary contact device to operate the auxiliary contacts as the electric control device goes from one operating position to another. When the auxiliary contact device is released by the actuating member the auxiliary contact device is spring biased to return to its normal position. The biasing means utilized in auxiliary contact combinations has created problems in some control applications because the operating means must perform additional work against the biasing to close the primary contacts, thus requiring larger electromagnetic coils. This biasing also increases the possibility of premature dropout of the coil under low operating voltage conditions.

SUMMARY OF THE INVENTION

This invention provides an electric control device with a unique and novel auxiliary contact arrangement that has several advantages over any type heretofore used in the prior art. This new auxiliary contact arrangement provides a slot-like means formed as an integral part of the electromagnetic operating structure which is disposed to receive a projection of the auxiliary contact-carrying structure whereby the auxiliary contact carrying structure is in direct engagement with the electromagnetic operating means. Thus, no biasing means is required to return the auxiliary contacts to their normal operating position because this new direct engagement between the auxiliary contacts and the electromagnetic operating means ensures that the two operating positions are always consistent. The elimination of the biasing means in the auxiliary contacts also reduces the electric coil size required to operate auxiliary contacts associated with the electric control device and does not contribute to dropouts of the operating coil under low-voltage conditions.

DESCRIPTION OF THE PREFERRED EMBODIMENTS

This invention relates generally to an electric control device of the type disclosed in the application of John P. Conner and Kurt A. Grunert, Ser. No. 369,715 filed May 25, 1964, now U.S. Pat. No. 3,296,567. Inasmuch as a detailed description of an electric control device is disclosed in the aforementioned patent to which reference is made for complete description of structure and operation, the description of those portions is limited to the parts that are essential to the operation of the invention disclosed herein.

Figure 2:
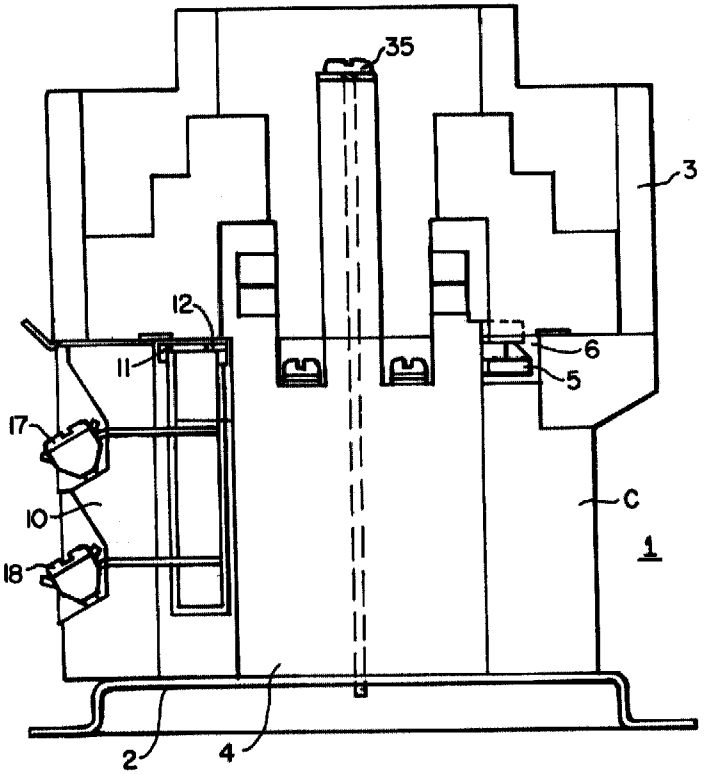
FIG. 2 is a side view of an electric control device with an auxiliary contact device shown in position.
Figure 1:
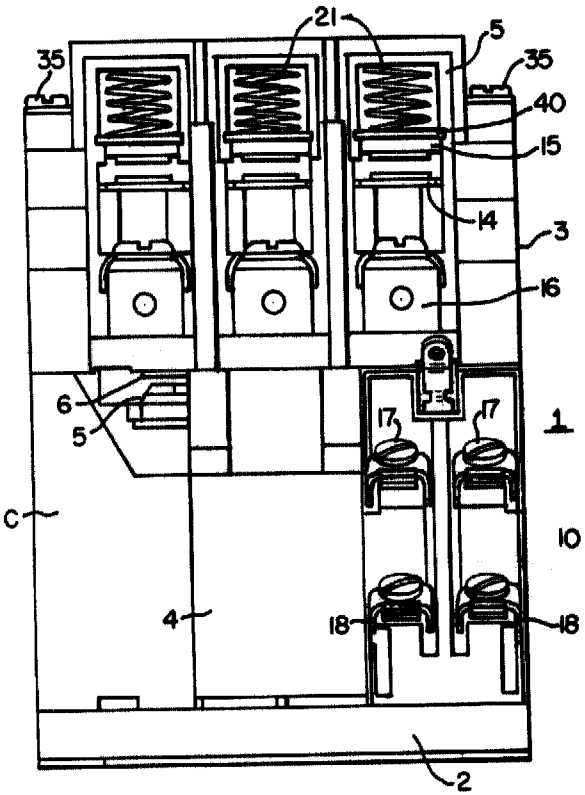
FIG. 1 is an elevation view of an electric control device with an auxiliary contact device shown in position.
Figure 3:
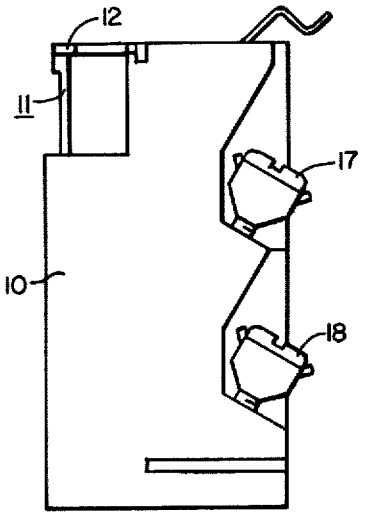
FIG. 3 is a side view of an auxiliary contact device.
Figure 4:
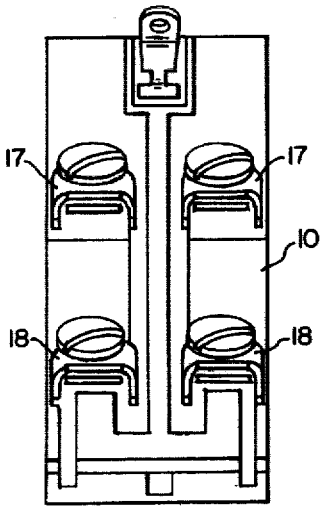
FIG. 4 is an elevation view of an auxiliary contact device.
Figure 5:
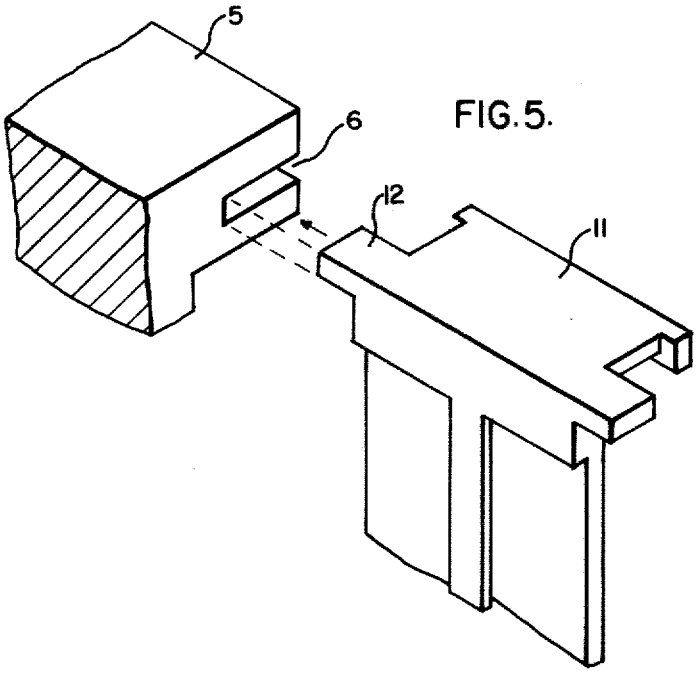
FIG. 5 is an exploded view of actuating member incorporating the principles of this invention.

Referring to FIGS. 1 and 2 there is shown an electric control device 1 of the type well known in the art. The electric control device is comprised of an upper insulating housing part 3, a lower insulating housing part 4, and base plate 2. The upper housing part 3 comprises a molded insulating contact carrier 5, movable contact members 15 mounted in window openings of the contact carrier 5, a separate compression spring 21 which biases spring support 40 against the associated movable contact member 15 to provide for resilient contact engagement, and a generally U-shaped armature, not shown but well known in the art, is connected to the contact carrier 5. Also connected to the upper housing part are stationary contact members 14 and terminal members 16. The lower housing part 4 is comprised of a coil and magnetic core member, also not shown, but well known in the art. The entire assembly rests upon the base plate and is held together by means of two screws 35 which pass through the upper housing 3, the lower housing 4, and into threaded openings of the base plate 2. The upper housing part 3, the lower housing part 4 and the base plate 2 are formed to provide four cavities C at the four corners of the control device, an arrangement well known in the art.

Referring now to FIGS. 1–5, a projection of the contact-carrying structure 5 is disposed to extend within the four cavities of the control device. The contact-carrying structure 5 is formed to provide slot openings 6. There is shown mounted in one of the cavities C an auxiliary contact device 10 having an auxiliary contact-carrying structure 11. The auxiliary contact carrying structure 11 has a projection 12 which is disposed to snap firmly into the slot openings 6 when the auxiliary contact device 10 is placed in a cavity C.

The engagement of the projection 12 of the auxiliary contact device and the slot means 6 of the contact-carrying structure 5 form a direct connection between the electromagnetic operating means and the auxiliary contact device.

When the electric control device is energized the insulating contact carrier 5 is pulled down bringing the movable contacts 15 into electrical contact with the stationary contacts 14. At the same time, the contact carrier 5 by means of the slot 6 moves the projections 12 of the auxiliary contact carrier 11 downward operating the auxiliary contacts 17 and 18. When the control device is de-energized the contact carrier 5 moves upward to its normal position thus causing the slots 6 to carry the auxiliary contact carrier 11 to its normal position.

The new engagement shown here between the auxiliary contact device and the operating mechanisms of the control device is advantageous over previous apparatus used in the art. It eliminates the need for spring biasing in the auxiliary contact device that tends to increase the workload of the electric control device and it decreases the amount of electrical power required for operation. This new engagement also adds to the overall simplicity of the electric control device by causing the auxiliary contact device to act as an integrated unit with the operating mechanism of the electric control device.

We claim:

1. An electric control device, comprising:

(a) a base;

(b) a first insulating housing mounted on the base;

(c) a control mechanism supported on the housing;

(d) the control mechanism comprising a first stationary and movable contact combination;

(e) the first stationary and movable contact combination being disposed to open and close an electric circuit;

(f) operating means disposed to open and close the first stationary and movable contact combination between the opened and closed operating positions;

(g) the operating means comprising a coil and armature combination;

(h) the operating means further comprising a first insulating contact-carrying structure mounted generally upon the armature;

(i) the first stationary contact is generally mounted upon the first insulating housing;

(j) the first movable contact is generally mounted upon the first insulating contact-carrying structure whereby upon energization of the coil, the armature is disposed to move the first insulating contact-carrying structure to carry the first movable contact into engagement with the first stationary contact to open and close an electric circuit; and (h) an auxiliary contact device comprising a second insulating housing mounted generally upon the first insulating housing; a second stationary contact and movable contact combination being disposed generally within the second insulating housing; a second insulating contact-carrying structure whereby the second movable contact is generally mounted thereon; the second insulating contact-carrying structure is disposed to carry the second movable contact into engagement with the second stationary contact to open and close an electric circuit; and connecting means for connecting the first insulating contact-carrying structure to the second insulating contact-carrying structure whereby operating motion of the first insulating contact-carrying structure causes operating motion of the second insulating contact-carrying structure.

2. An electric control device as recited in claim 1 whereby the connecting means comprises the first insulating contact-carrying structure having slot-like means therein and the second insulating contact carrying structure having a projection disposed to extend generally within said slot-like means.

* * * * *